United States Patent [19]

Giroux

[11] Patent Number: 4,940,857

[45] Date of Patent: Jul. 10, 1990

[54] INSULATOR FOR OVERHEAD ELECTRIC WIRES

[76] Inventor: Pierre R. Giroux, 1515 Papineau Street, Trois-Rivières, Canada, G8Z 4H7

[21] Appl. No.: 394,064

[22] Filed: Aug. 15, 1989

[51] Int. Cl.[5] ..... H01B 17/20

[52] U.S. Cl. ..... 174/174; 174/202

[58] Field of Search ..... 174/165, 168, 172, 173, 174/174, 194, 195, 200, 202, 203, 204, 205, 206, 210, 212

[56] References Cited

U.S. PATENT DOCUMENTS

| | | | |
|---|---|---|---|
| 430,296 | 6/1890 | Oakman | 174/174 |
| 482,297 | 9/1892 | Clark | 174/212 X |
| 803,010 | 10/1905 | Morris | 174/174 X |
| 1,291,139 | 1/1919 | Reese | 174/168 |
| 1,810,950 | 6/1931 | Earhart | 174/194 X |
| 4,810,837 | 3/1989 | Giroux | 174/172 |

*Primary Examiner*—Laramie E. Askin

[57] ABSTRACT

The insulator, preferably made of porcelain, is of the type comprising a lower bell-shaped portion, an intermediate annular, waist portion and an upper saddle portion for receiving and supporting an electric transmission overhead wire. The insulator is of the type having an axial blind bore opening at its lower end for receiving an upstanding support pin. The saddle portion includes a transversely-curved groove substantially normal to the axial bore and jutting parts on each side of the wire-receiving groove and laterally protruding from the waist portion. Each jutting part has an external face which is provided with a partly annular groove, generally coaxial with the bore and of greater radius than that of the waist portion. These annular grooves are adapted to positively retain the inturned flanges of a wire-retaining clamp despite an upward force or a laterally-upwardly-directed force exerted by the wire on the clamp. The waist portion can still be used for attaching the electric wire by a tie-wire.

5 Claims, 1 Drawing Sheet

INSULATOR FOR OVERHEAD ELECTRIC WIRES

FIELD OF THE INVENTION

The present invention relates to a pin type insulator to be used with a clasp for fixing an electrical overhead wire to the insulator.

BACKGROUND OF THE INVENTION

Overhead electric wires are usually carried by porcelain insulators which are maintained upright by an upstanding pin engaging an axial blind bore of the insulator body, the pin fixed to the cross-arm of a pole or tower. The insulator has a saddle-like upper portion which receives and supports the electric wire. The latter is attached to the insulator by the tricky operation of manually winding and twisting a small-diameter tie wire around the electric transmission wire and a waist portion at the base of the insulator saddle portion. In applicant's U.S. Pat. No. 4,810,837, issued Mar. 7, 1989 and entitled: "CLASP FOR FIXING AN ELECTRICAL WIRE TO AN INSULATOR AND METHOD OF FIXATION", there is described a novel clasp which considerably facilitates attachment of the electrical wire to the insulator. This clasp includes a metallic clamp and an elastomeric wire-gripping element carried inside the clamp for surrounding and being pressed against the wire for firmly retaining the latter against longitudinal slipping. The clamp itself is a metal piece forming a central top web, with lateral downwardly-extending arms, in turn provided with inturned lower flanges, each having an inner partly-circular recess. Conventional insulators have a lower bell shaped portion and a saddle portion. The saddle portion includes a transverse electric wire-receiving groove and jutting parts on each side of the groove. The external surface of each jutting part includes side face portion, which is downwardly, inwardly inclined and which smoothly merges with the top of the bell-shaped portion at a narrowest waist area between the top saddle portion and the lower bell-shaped portion. Therefore, when using the clasp of U.S. Pat. 4,810,837 on a conventional insulator of the type above described, it was found that the clamp can detach from the insulator under certain circumstances circumvented by the present invention.

OBJECTS OF THE INVENTION

The main object of the invention is thus to provide an electric wire insulator especially designed for use with the wire-gripping clasp of U.S. Pat. No. 4,810,837 and which will more positively prevent detachment of the clamp from the insulator.

Another object of the present invention is to provide an insulator of the character described which facilitates fixing of the clasp to the insulator, as compared to a conventional insulator.

SUMMARY OF THE INVENTION

The electric wire insulator of the invention comprises a body made of electrically-insulating material, having a top and a bottom end and forming a lower bell-shaped portion, an intermediate, annular, waist portion and a top saddle portion, the body having an axial bore opening at its bottom end for receiving an upright support pin, the saddle portion having a transversely-curved electric wire-receiving groove substantially normal to said axial bore, and jutting parts on each side of said groove and laterally protruding from said waist portion, said jutting parts each having an external face facing away from said groove and provided with a partly annular clamp-retaining groove, generally coaxial with said bore and of greater radius than the minimum radius of said waist portion, the two clamp-retaining grooves adapted to positively retain the inturned flanges of a clamp having a central web for overlying said wire-receiving groove and said wire and downturned arms for embracing said jutting parts with said flanges extending from said lower ends of said arms.

Preferably, the clamp-retaining grooves are of generally downturned L-shape cross-section, with one leg defining a flat partly-annular face generally normal to said bore and facing towards said bell shaped lower portion. Preferably, the other leg of the L defines a cylindrical face facing away from said axial bore. Preferably, the top portion of each jutting part includes a downwardly- and radially-outwardly inclined external top face portion adapted to receive the inner edges of said flanges to cause outward spreading of the downturned arms upon fixing of said clamp to said insulator by a downward force exerted on the web of said clamp.

Preferably, the radially inner edge of said top inclined face portion is at a smaller radial distance from said axial bore than is the cylindrical face portion of the annular groove from the same axial bore. This ensures that, when the clamp is about to be snapped in position on the insulator, the clamp, when centered, will have the inner edge of its inturned flanges already resting on the inclined top face portion to cause spreading-apart of the downturned arms of the clamp when the latter is pressed down in the insulator. The waist portion of the insulator can be used to tie the electric wire by a tie-wire if the clasp of the above-noted patent is not available.

DETAILED DESCRIPTION OF THE INVENTION

Figure 1:
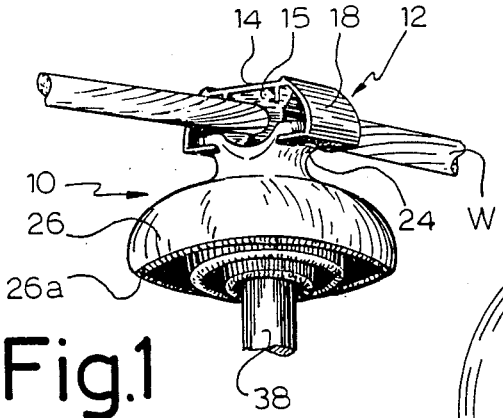
FIG. 1 is a perspective view of the pin type insulator according to the invention, of a segment of an electric wire and of a clasp attaching the wire to the insulator, and finally of an upstanding pin supporting the insulator.
Figure 4:
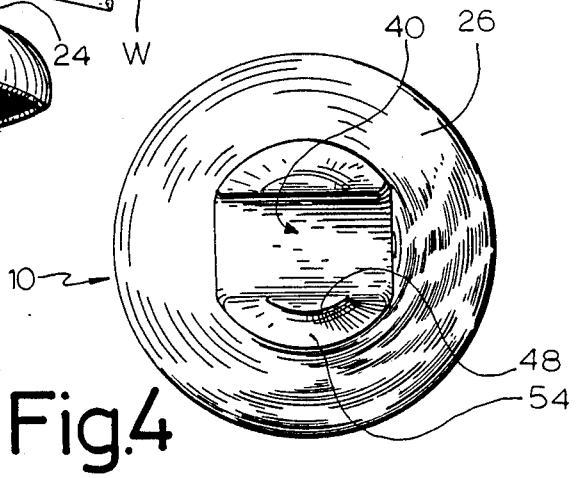
FIG. 4 is a top plan view of the insulator.
Figure 2:
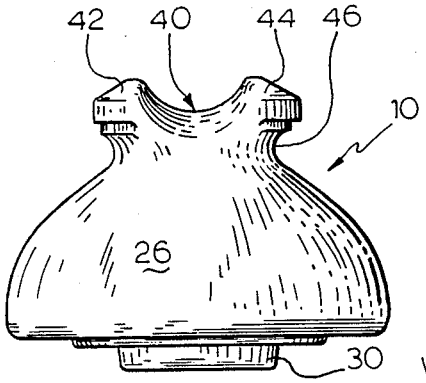
FIG. 2 is a side elevation, at an enlarged scale, of the insulator.
Figure 5:
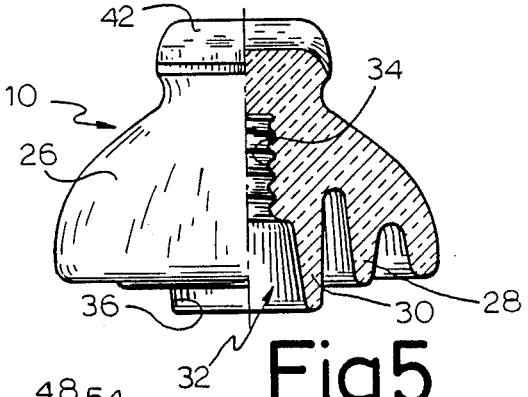
FIG. 5 is a partly-sectional, side elevational view of the insulator, at the scale of FIG. 2, and rotated through a quarter-turn with respect to the view of FIG. 2.

A section of electrical wire is attached to an insulator 10 by a clasp 12. Clasp 12 is the one described in the above-noted U.S. Pat. No. 4,810,837, issued to the present inventor. Such a clasp comprises a clamp and a sheath, or wire gripping element, carried by the clamp inside thereof. The clamp is preferably made of an extrusion of aluminum cut to length and machined, including a flat central web portion 14, two opposite downwardly-curved arms 16 and 18 and inturned flanges 20 and 22 extended from the lower ends of the side arms 16 and 18. Each flange 20, 22 has a semi circular recess 24 at its inner edge. The wire-gripping element or sheath is indicated at 15 and includes a body of elastomeric partly-conducting material, which is anchored within the clamp web 14 and is adapted to surround and grip the electrical wire W.

Insulator 10 is made from an insulating material of high resistivity, such as porcelain. Insulator 10, like any other conventional insulators of the same type, is formed with a lower bell-shaped portion 26 forming a skirt surrounding a pair of concentric, circular, integral inner wall portions 28 and 30. The radially innermost wall 30 extends beyond the plane of the bottom edge 26A of exterior skirt 26 and defines an inner central blind bore 32, having an upper threaded section 34 and an enlarged lower section 36, which is frusto-conical. Blind bore 32 is coaxial with skirt 26 and walls 28, 30. A threaded support pin 38 is adapted to be screwed in bore section 34 to support the insulator 10 in upright position. Pin 38 upstands from the cross-arm of a utility pole or tower, not shown.

Figure 3:
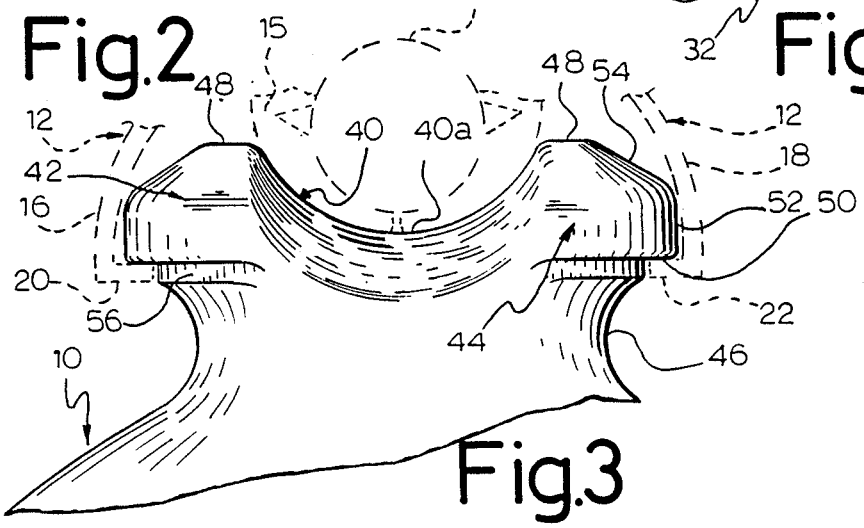
FIG. 3 is an enlarged partly-broken view of the upper section of the insulator of FIG. 2 and further showing in phantom lines the electrical wire and part of the overlying clasp.

The upper portion of the insulator forms a saddle 40 for receiving and supporting the electric wire W. This saddle 40 includes a central transversely-arcuate wire-receiving groove **40*a*, and two diametrically opposite, similar, jutting parts 42, 44. Groove-4*a* receives the sheath member 15 surrounding the wire W, as shown in FIG. 3. The saddle 40 merges with skirt 26 at the top of the latter through a narrowest annular waist portion 46 forming the junction of the top of skirt 26 with the base of the saddle 40. This saddle 40 is of a width smaller than the widest portion of the skirt 26** but greater than said annular waist portion.

As described in applicant's above-noted U.S. Patent for the attachment of the wire W to the insulator 10 by means of the clasp 12, the bendable arms 16, 18 of the clamp must be spread apart to clear the jutting parts 42, 44, so as to bring flanges 20, 22 around and under the parts 42, 44, whereby the clasp 12 can be locked to the insulator.

Referring to the external shape of each jutting part 42, 44 of a standard insulator as described in the above U.S. Patent, it will be clear that upward force exerted by the wire W on the clasp 12 could cause the flanges of the clamp to slide upwardly along the upwardly- and outwardly-inclined faces immediately above the narrowest waist portion 46, Also, with the conventional insulator, the shape of the top portions of the jutting parts does not facilitate the spreading-apart of the bendable arms 16,18.

The heart of the invention lies, therefore, in the external shape of each jutting part 42, 44, so as to prevent removal of the clasp from the insulator under the above-noted forces exerted by the wire on the clasp.

Each jutting part 42, 44 has a top face portion 48 merging with the groove **40*a*. The plane of the two top face portions 48 is preferably normal to the lengthwise axis of bore 32. Faces 48, which have been illustrated as being flat and coplanar, can have other shapes, such as a convex shape. Top face portions 48 are surrounded by a radially outer, generally frusto-conical face portion 54, which is radially outwardly and downwardly inclined and merges at its outer edge with a cylindrical side face portion 52**

A partly-annular clamp-retaining groove having an inverted L-shaped cross-section is formed in each jutting part 42, 44 by a flat face portion 50 and a cylindrical face portion 56. Each face portion 50 is an underface which is located immediately above face portion 56 and which is parallel to top face portion 48 and which is normal to the lengthwise axis of bore 32. The cylindrical outwardly-facing face 56 of the downturned L-shape groove is at a radial distance from the bore 32 which is greater than the radial distance from said bore 32 of the inner edge of top inclined face portion 54, and greater than the smallest radius of the waist portion 46.

The down-turned L-shape partly annular clamp-retaining groove formed by faces 50,56 is disposed at such a level as to ensure positive gripping action of clasp 12 on both the conductor wire and its insulator. Jutting parts 42, 44, and consequently also faces 50, 56, extend, when seen in top plan view, through a circular arc of about 90 degrees.

The inclination of faces 54 should be sufficient to produce definite slipping thereon without overcoming too much of the inherent resistance of clasp 12, as some of the resistance is needed to lift wire W off the insulator in the process of clasping, as described in applicant's above-noted patent. In other words, the arms 16 and 18 of the clamp must not spread apart fully before the clamping tool has completed wire lifting while resting on web 14.

The radius of curvature of faces 56 is about equal to that of the recesses 24 of flanges 20 and 22. As shown in FIG. 3, since clamp flanges 20, 22, when installed, flatly underlie faces 50, which are normal to the insulator longitudinal axis, any upward force component exerted by wire W thereon will be much better resisted than if the clasp 12 were used on a conventional insulator, with upwardly-flaring inclined faces below the jutting parts, as shown in applicant's patent in which the inverted grooves defined by the seat faces 50 and 56 are clearly absent.

Also, during installation, the edges of the recesses 24 of the clamp will be forced to slide along the inclined top faces 54 and, thus, the arms 16, 18 will spread apart, so that the flanges 20,22 will then slide down side faces 52 and snap inwardly to abut cylindrical faces 56 under the bias of the inherent resiliency of clamp 12.

I claim:

1. An electric wire insulator comprising a body made of electrically-insulating material having a top and a bottom end and forming a lower bell-shaped portion, an intermediate, annular, waist portion and a top saddle portion, said body having an axial bore opening at said bottom end for receiving an upright support pin, said top saddle portion having a transversely-curved wire-receiving groove substantially normal to said axial bore, said top saddle portion forming jutting parts on each side of said wire-receiving groove and laterally protruding from said waist portion, said jutting parts each having an external face facing away from said wire-receiving groove and provided with a partly-annular clamp-retaining groove, generally coaxial with said bore and of greater radius than the minimum radius of said waist portion, said clamp-retaining grooves adapted to positively retain the inturned flanges of a clamp having a web for overlying said wire-receiving groove and an electric wire supported therein, and downturned arms for embracing said jutting parts with said flanges extending from the lower ends of said arms.

2. An electric wire insulator as defined in claim 1, wherein each clamp-retaining groove is of generally downturned L-shape cross-section, with one leg of the L defining a flange-retaining face generally normal to said bore and facing towards said bell-shaped lower portion and with the other leg of said L defining a generally cylindrical face facing outwardly and generally coaxial with said bore.

3. An electric wire insulator as defined in claim 2, wherein the external face of each jutting part further includes a radially inner top face portion immediately adjacent said wire-receiving groove, followed by an outwardly- and downwardly-inclined radially outer top face portion, in turn followed by a generally cylindrical side face portion, which merges at its lower edge with said flange-retaining face of said partly annular groove, said downwardly-inclined top face portion facilitating spreading-apart of said flanges to clear said side face portions when said web is pushed downwardly against said insulator.

4. An electric wire insulator as defined in claim 3, wherein the radial distance of the cylindrical face of each clamp-retaining groove from said bore is greater than the radial distance of the adjacent radially inner edge of said top inclined face portion from said bore.

5. An electric wire insulator as defined in claim 4, wherein said faces of each clamp-retaining groove extend through a circular arc of about 90 degrees.

* * * * *